US009597894B2

(12) United States Patent
Buxton et al.

(10) Patent No.: US 9,597,894 B2
(45) Date of Patent: Mar. 21, 2017

(54) THERMAL PRINTER

(71) Applicant: VIDEOJET TECHNOLOGIES INC., Wood Dale, IL (US)

(72) Inventors: Keith Buxton, Nottingham (GB); Philip Hart, Nottinghamshire (GB); Jeremy Ellis, Nottinghamshire (GB)

(73) Assignee: Videojet Technologies, Inc., Wood Dale, IL (US)

( * ) Notice: Subject to any disclaimer, the term of this patent is extended or adjusted under 35 U.S.C. 154(b) by 0 days.

(21) Appl. No.: 14/901,787

(22) PCT Filed: Oct. 10, 2014

(86) PCT No.: PCT/GB2014/053062

§ 371 (c)(1),
(2) Date: Dec. 29, 2015

(87) PCT Pub. No.: WO2015/052540

PCT Pub. Date: Apr. 16, 2015

(65) Prior Publication Data

US 2016/0159105 A1 Jun. 9, 2016

(30) Foreign Application Priority Data

Oct. 11, 2013 (GB) ..... 1318085.6

(51) Int. Cl.

| | |
|---|---|
| ***B41J 2/355*** | (2006.01) |
| ***B41J 2/35*** | (2006.01) |
| ***B41J 2/36*** | (2006.01) |

(52) U.S. Cl.

CPC ..... *B41J 2/3558* (2013.01); *B41J 2/35* (2013.01); *B41J 2/355* (2013.01); *B41J 2/3553* (2013.01); *B41J 2/36* (2013.01)

(58) Field of Classification Search

CPC ... B41J 2/35; B41J 2/355; B41J 2/3551; B41J 2/3553; B41J 2/3555; B41J 2/3556; B41J 2/3558

See application file for complete search history.

(56) References Cited

U.S. PATENT DOCUMENTS

2003/0202085 A1* 10/2003 Rother ..... B41J 2/3553 347/191

* cited by examiner

*Primary Examiner* — Kristal Feggins

(57) ABSTRACT

An apparatus for determining the resistance of a printing element of a print head, the apparatus comprising: a print head comprising a plurality of individually controllable printing elements connected in parallel, and a capacitor connected in parallel with the printing elements; a test voltage supply arranged to supply a test voltage to the print head; a current monitor arranged to measure the current supplied to one of the printing elements when the said one of the printing elements is connected to the test voltage supply; and a controller arranged to determine the resistance of the said one of the printing elements based upon the measured current.

20 Claims, 4 Drawing Sheets

THERMAL PRINTER

This invention relates to a method and apparatus for determining the resistance of a printing element of a thermal print head of a thermal printer.

Thermal transfer printers use an ink carrying ribbon. In a printing operation, ink carried on the ribbon is transferred to a substrate which is to be printed. To effect the transfer of ink, the print head is brought into contact with the ribbon, and the ribbon is brought into contact with the substrate. The print head contains printing elements which, when heated, whilst in contact with the ribbon, cause ink to be transferred from the ribbon and onto the substrate. Ink will be transferred from regions of the ribbon which are adjacent to printing elements which are heated. An image can be printed on a substrate by selectively heating printing elements which correspond to regions of the image which require ink to be transferred, and not heating printing elements which correspond to regions of the image which require no ink to be transferred.

The use of a print head in which a printing element is not operational could lead to defective printing operations. For example, if a printing element is not operational, an image printed may be missing ink in the region of the image corresponding to the non-operational printing element because ink had not been transferred to the substrate.

A printing element may be non-operational if it is physically damaged in some way, or if it is electrically defective. A defective printing element may have a different resistance than an operational printing element. For example, a defective printing element may have an infinite resistance (i.e. open circuit), or an extremely small resistance (i.e. short circuit), or a resistance which is outside of a predetermined range of acceptable resistance values.

The resistance of a printing element can therefore be used as an indicator of the operational state (or health) of that printing element.

There are known methods for measuring printing element resistance. In one such method, a reference resistor, having an accurately known resistance of a comparable value to the nominal resistance of a printing element is connected in parallel with a print head capacitor. The print head capacitor is charged to a known voltage level.

The time taken for the capacitor to be discharged through the reference resistor is then measured. This discharge time is then compared with the time taken to discharge the capacitor through a printing element under test. The comparison of these times allows an estimate to be made of the resistance value of the printing element.

It will be appreciated that the time taken to discharge a capacitor through a resistor is governed by a time constant associated with the capacitance and resistance of the capacitor and resistor respectively. The voltage across a capacitor, when discharged from an initial voltage is given by the following relationship:

$$V(t) = V_0(e^{-\frac{t}{RC}}) \quad (1)$$

where:

V(t) is the voltage across the capacitor at a given time, t;

$V_0$ is the initial voltage across the capacitor;

t is the elapsed time in seconds;

R is the resistance of the resistor through which the capacitor is being discharged; and C is the capacitance of the capacitor.

The voltage will be understood to decay as an exponential, reducing to approximately 36% of the initial value after one time constant (RC), to approximately 14% of the initial value after two time constants (2×RC), and to approximately 5% of the initial value after three time constants (3×RC), and so on.

Considering the arrangement of a conventional print head, it can therefore be understood that the time taken to discharge the print head capacitance through a printing element will be governed by the system time constant (RC) where R is the printing element resistance and C is the capacitance. Taking a typical resistance of 1265Ω and a typical capacitance of 22 μF, the print head time constant $T_{PH}$ is thus (1265Ω×22 μF) 27.8 ms.

It is also known to measure the voltage decay from a known first voltage, to a known second voltage, for a reference resistance, and then to perform the same discharging through the printing element under test. By comparing the discharge times between the voltages concerned it is possible to calculate the printing element resistance.

Given the way in which voltage decays, to use any such resistance measurement method involves waiting for a time period which is several multiples of the print head time constant $T_{PH}$ while the relatively large print head capacitor is charged or discharged. This problem is exacerbated by the resistance and capacitance of the standard components used in a print head which mean that the print head time constant $T_{PH}$ is, as noted above, relatively large.

In an alternative known method, the voltage across a capacitor within a print head is measured as a function of time when the capacitor is discharged through the printing element under test. The rate of change of voltage across the capacitance can then be used to calculate the approximate resistance of the printing element. However this method suffers from the same properties associated with the print head time constant $T_{PH}$ mentioned above, meaning that it is inherently limited by the response time of the components involved, which values cannot be changed. Further, this method relies on the stability and accuracy of the value of the print head capacitor. However, as a component part of a relatively disposable print head, the capacitor is not chosen so as to provide a stable reference. A cheap capacitor is likely to suffer from initial value uncertainty, instability, and possible decay after prolonged use.

Furthermore, for each subsequent measurement of the resistance of a printing element using the methods described above, a capacitor must be charged and discharged, with the discharge monitored so as to monitor the duration of discharge to a predetermined level, or slope of the discharge. In either case, the long time constants associated with the print head (approximately 30 ms) mean that to measure several printing elements will take a significant duration of time. A typical print head may comprise 1280 printing elements. If testing each of those elements took approximately three times the print head time constant $T_{PH}$, then the total testing duration for a print head would approach 2 minutes.

It is an object of the present invention to obviate or mitigate one or more of the problems associated with known methods of determining the resistance of printing elements.

According to a first aspect of the invention there is provided an apparatus for determining the resistance of a printing element of a print head, the apparatus comprising: a print head comprising a plurality of individually controllable printing elements connected in parallel, and a capacitor connected in parallel with the printing elements; a test voltage supply arranged to supply a test voltage to the print head; a current monitor arranged to measure the current supplied to one of the printing elements when the said one of the printing element is connected to the test voltage supply; and a controller arranged to determine the resistance of the said one of the printing elements based upon the measured current.

The present invention therefore provides a convenient mechanism for determining the resistance of a printing element through measuring the current drawn by the printing element from the test voltage.

The current monitor may be connected in series between the test voltage supply and the print head.

The connection of the current monitor in series between the test voltage supply and the print head has the effect of allowing the current flowing through the current monitor and the printing element from the test supply to stabilise relatively quickly. This has the beneficial effect of allowing resistance to be determined more quickly than in some prior art methods. The relatively quick stabilisation of current flow is particularly the case where different ones of the printing elements are being connected to the test voltage supply in turn, the connection of different ones of the printing elements causing small voltage and current fluctuations. This is because the connection of the current monitor (which may be a low resistance device) in the manner described has minimal effect on the voltage across the printing element and the capacitor during the current measurement and between subsequent current measurements. As such, where different ones of the printing elements are connected to the test supply, the small variations in voltage caused by the connection of different ones of the printing elements will quickly stabilise. This allows the resistance of a plurality of printing elements to be determined quickly, each one of the printing elements being connected to the test voltage supply in turn.

The current monitor may comprise a sensing resistor connected in series between the test voltage supply and the print head, and a voltage amplifier for measuring the voltage across the sensing resistor.

The provision of a sensing resistor in combination with a voltage amplifier provides a convenient way of monitoring the current flowing to the print head. The voltage amplifier may be a differential amplifier with a first input connected to a first terminal of the sensing resistor and a second input connected to a second terminal of the sensing resistor. The output of the voltage amplifier is a voltage which is indicative to the voltage across the sensing resistor. The output of the voltage amplifier may be a voltage which is proportional to the current through the sensing resistor.

The current monitor may be switchably connected in series between the test voltage supply and the print head.

A switchable arrangement of the current monitor allows the test voltage supply to be isolated from the print head when the test voltage supply is not required, for example during normal printing operations.

The current monitor may have a lower resistance than the resistance of a printing element. Preferably the current monitor has a resistance of less than 100 ohms. More preferably the current monitor has a resistance of less than 50 ohms. Even more preferably the current monitor has a resistance of less than 5 ohms or even less than 2.5 ohms. For example, the current monitor may have a resistance of about 4.7 ohms. The sensing resistor may have a lower resistance than the resistance of a printing element.

A low resistance for the current monitor enables the time taken for the voltage across the capacitor to stabilize after the printing element has been connected to the test voltage supply to be a very small fraction of the time constant associated with the printing element and the capacitor. In the instant after a printing element is connected to the test voltage supply, a majority of the current flowing through the printing element will be provided by the capacitor. However, the use of a low resistance current monitor ensures that the voltage drop across the current monitor, and resulting voltage adjustment across the print head capacitor, is small, allowing it to be stabilised in a short time period. A printing element may have a resistance of about 1265 ohms. A print head capacitor may have a capacitance of 22 microfarads. Therefore, the time constant associated with a single printing element (i.e. the combination of a 1265 ohm resistor and a 22 microfarad capacitor) is around 28 milliseconds. For example, where the current monitor has resistance which is less than 100 ohms this is likely to bring about at least an order of magnitude reduction in the time required for the current flowing from the test voltage supply to stabilize (i.e. for current not to be supplied from the print head capacitor). A current monitor resistance of less than 10 ohms is likely to be more than two orders of magnitude lower resistance than a printing element, bringing about at least two orders of magnitude reduction in the time required for the current to stabilize. Further reduction in the stabilization time can be achieved by reducing the resistance of the current monitor further. A current monitor resistance of 4.7 ohm results in a time to stabilize which is more than 270 times smaller than the stabilization time associated with the use of a current monitor resistance which was of comparable resistance to the resistance of a printing element. Lower resistances are possible and will result in an even greater reduction of the time required to stabilize the current flowing through the current monitor and to the printing element.

The apparatus may further comprise a printing voltage supply, the printing voltage supply being arranged to supply a printing voltage, wherein the test voltage is lower than the printing voltage.

A test voltage is only required for resistance testing purposes, and is therefore not required to drive as much current to the printing elements as during a printing operation. Therefore, a test voltage which is lower than the printing voltage can be used. Moreover, as the power dissipated by a resistor increases as the square of the voltage applied, any reduction in voltage brings about a larger reduction in power dissipated. Any reduction in power dissipated during testing a printing element will reduce wasted power, and will also increase the lifetime of the printing element. Further, when the normal printing voltage is applied to a printing element, even for a relatively short duration of time (e.g. <1 ms) there will be significant heating of the resistive printing element. Heating of the printing element (which is required during printing operation) will result in the resistance typically decreasing, due to the negative temperature coefficient of resistance of the printing element. This would make the resistance measurement less accurate. The use of a lower test voltage reduces the heating effect, and therefore improves measurement accuracy.

The apparatus may further comprise a voltage monitor arranged to monitor the voltage across the said one of the printing elements when said one of the printing elements is connected to the test voltage supply.

Monitoring the voltage across the printing elements allows an accurate measure of the voltage to be established for each printing element, allowing, in turn an accurate resistance value to be determined. A voltage measurement may be taken for each printing element tested, Alternatively, a voltage measurement may be taken after a number of printing element tests.

The apparatus may further comprise a blocking diode arranged to prevent flow of current from the printing voltage supply to the test voltage supply.

The presence of the blocking diode ensures that the test voltage supply is not exposed to high voltages associated with printing operations. This may be important where a test voltage supply contains sensitive components which could be damaged by exposure to high voltages.

The apparatus may further comprise a discharge path for discharging the capacitor.

The use of a current monitor as described above allows the resistance of a plurality of printing elements to be determined quickly, each one of the printing elements being connected to the test voltage supply in turn. However, before any printing elements are tested, it may be necessary to discharge the voltage across the capacitor to the level of the test voltage from a higher voltage. Providing a discharge path allows the capacitor to be discharged in a controlled manner.

The discharge path may have a lower resistance than the resistance of a printing element.

Providing a discharge path with a lower resistance than the resistance of a printing element allows the capacitor to be discharged in a controlled manner and more quickly than would be possible by discharging the capacitor through a printing element. The discharge time is affected by the RC time constant of the capacitor and the resistance of any resistors through which it is discharged. The lower the resistance, the shorter the time constant and consequently the faster the discharge. Thus a lower resistance discharge path allows a first printing element to be tested more quickly after printing operations have been carried out.

The discharge path may have a resistance of less than 500 ohms.

A printing element may have a resistance of over 1000 ohms. Therefore a discharge path resistance of less than 500 ohms will provide at least a factor of two reduction in the discharge time compared to a capacitor being discharged through a printing element.

According to a second aspect of the invention there is provided a thermal transfer printer incorporating the apparatus of the first aspect of the invention, the printer further comprising: first and second spool supports each being configured to support a spool of ribbon; and a ribbon drive configured to cause movement of ribbon from the first spool support to the second spool support; wherein the print head is configured to selectively transfer ink from the ribbon to a substrate, the print head being moveable towards and away from a printing surface, during printing.

A thermal transfer printer incorporating a print head resistance monitor provides a convenient mechanism for determining the resistance of a printing element through measuring the current drawn by the printing element from the test voltage.

The invention also provides a thermal printer in which the printhead is arranged such that its constituent printing elements cause a thermally sensitive substrate to be heated.

According to a third aspect of the invention there is provided a method of determining the resistance of a printing element of a print head, the print head comprising a plurality of individually controllable printing elements connected in parallel, and a capacitor connected in parallel with the printing elements, the method comprising: connecting one of the printing elements to a test voltage; waiting for a predetermined time period; measuring the current drawn by the printing element from the test voltage; and determining the resistance of the printing element based upon the measured current.

The present invention therefore provides a convenient mechanism for determining the resistance of a printing element through measuring the current drawn by the printing element from the test voltage.

Measuring the current drawn by the printing element may comprise using a current monitoring device connected in series between a test voltage supply arranged to supply the test voltage and the print head.

The predetermined time period may be sufficient to allow the current delivered to the printing element from the test voltage supply to become substantially constant.

After a predetermined period of time the current flowing through the printing element will be substantially constant, such that any measurement of the current will be an accurate representation of the current flowing through the printing element, allowing an accurate determination to be made of the resistance of the printing element. Any fluctuations in current could result in an inaccurate determination of the resistance of the printing element. It will be appreciated that where a capacitor is charged or discharged through a resistor there will be a characteristic time constant (RC) associated with any change in the voltage level across the capacitor, and that after the duration of that time constant any fluctuations in voltage will be reduced. A voltage (and therefore current) level may be considered to be substantially constant after one or more RC time constants has elapsed.

The predetermined time may be sufficient to allow the voltage level across the capacitor to reduce from the normal higher printing voltage level to substantially the same as the test voltage, or to allow the stabilisation of the voltage at the test voltage.

Alternatively, the predetermined time may be sufficient to allow both the voltage to reduce to substantially the same as the test voltage, and to allow the stabilisation of the voltage at the test voltage level.

The predetermined time period may be less than 30 ms. Preferably the predetermined time period is less than 10 ms.

Testing a first printing element after predetermined time period of less than 30 ms allows printing element testing to be carried out in relatively short idle times between printing operations. A predetermined time of just 10 ms or less would allow even shorter idle times between printing operations to be used for printing element tests.

The method may further comprise: disconnecting the first one of the printing elements from the test voltage; connecting a second one of the printing elements to the test voltage; waiting for a time period less than the predetermined time period; measuring a second current drawn by the second one of the printing elements from the test voltage; and determining the resistance of the second one of the printing elements based upon the measured second current.

Once a first measurement of current has been carried out, a subsequent measurement can be carried out after a reduced waiting time. This allows for the rapid measurement of a large number of heating elements after an initial waiting period has elapsed.

The time period may be less than 1 millisecond. The time period may be less than 200 microseconds. The time period may be about 100 microseconds.

When testing a print head having many printing elements, it is advantageous to be able to test each printing element in quick succession, allowing a large number of printing elements to be tested in the time available between printing operations. For example, for a print head having 1280 printing elements, where testing each element taking 10 ms, the total test time would be just 12.8 seconds (in addition to the predetermined time period). A further advantage can be realised by further reducing the time period associated with each measurement. The total testing time where testing each element takes 1 millisecond, could be as low as just 1.28 seconds. A further advantage still could be achieved by reducing the time period associated with each measurement further still. For example, a time period of around 300 microseconds would allow 1280 printing elements to be tested, in just 384 milliseconds (in addition to the predetermined time).

The method may further comprise: during a printing operation connecting one of the printing elements to a printing voltage, wherein the test voltage is lower than the printing voltage.

The test voltage may be lower than 10 volts.

A typical printing voltage may be 24 volts. A test voltage of less than 10 volts would therefore bring about a reduction in power dissipated of a factor 5, the power being related to the square of the voltage.

The method may further comprise measuring the voltage across the said one of the printing elements when the said one of the printing elements is connected to the test voltage. The voltage may be measured for each current measurement taken. Alternatively, the voltage may be measured for example every 10 or 100 printing elements.

Measuring the voltage across the printing element provides an accurate voltage measurement which can be used in subsequent resistance calculations. However, where stable operation conditions (e.g. temperature) are assured, measurement of the voltage for every printing element tested may be considered unnecessary.

The method may further comprise: discharging the capacitor from a voltage level substantially equal to the voltage supplied to the printing element during printing operations to a voltage substantially equal to the voltage supplied by the test voltage supply during the predetermined time period.

Discharging the capacitor from the printing voltage to the test voltage need only be done once during a testing procedure, as for subsequent test measurements, the voltage at the capacitor will remain substantially constant. Therefore, discharging the capacitor during the predetermined time period allows a printer, which has previously been engaged in printing activity, to be configured to allow rapid testing of a plurality of printing elements.

According to a fourth aspect of the present invention there is provided a method of determining the resistance of a plurality of printing elements of a print head, the print head comprising a plurality of individually controllable printing elements arranged adjacent one another, the method comprising: determining the resistance of a first one of the printing elements after a first time period; and determining the resistance of a second one of the printing elements after a second time period, wherein the second one of the printing elements is not adjacent to the first one of the printing elements, and wherein the first time period is adjacent to the second time period.

The first and second time periods are adjacent in the sense that no other printing element resistances are determined between the first and second time periods.

Testing non-adjacent printing elements in adjacent time periods ensures that any heating caused by the testing of a first printing element does not affect the measurement of an adjacent printing element.

The plurality of individually controllable printing elements may be arranged as a linear array.

Each printing element in a linear array will be adjacent to at least one other printing element (and most elements will be adjacent two other printing elements), therefore the method described above of sequentially testing non-adjacent printing elements is especially relevant to linear arrays.

The method may further comprise determining the resistance of a third one of the printing elements after a third time period, wherein the third one of the printing elements is not adjacent to the first one of the printing elements or the second one of the printing elements and wherein the third time period is adjacent to the second time period.

Testing a third element which is not adjacent to either of the first or second printing elements ensures that even where the effects of heating adjacent printing elements brought about by the testing of a printing element last longer than the testing time period, then no inaccurate resistance values will be determined by this method.

The first, second and third printing elements may be regularly spaced apart.

Sequentially testing the printing elements in a systematic way provides a reliable method of testing printing elements which can readily be extended to cover all printing elements in an array, while ensuring that each resistance measurement is not affected by any other measurement.

The plurality of printing elements may comprise a first set of printing elements and a second set of printing elements, wherein the first set of printing elements comprises said first, second and third ones of the printing elements, the method may further comprise: determining the resistance of a first one of the second set of printing elements; determining the resistance of a second one of the second set of printing elements; and determining the resistance of a third one of the second set of printing elements; wherein the first, second and third printing elements of the second set of printing elements are regularly spaced apart.

Sequentially testing the printing elements in a first set and then testing the printing elements in a second set provides a reliable method of testing all of the printing elements in an array, while ensuring that each resistance measurement is not affected by any other resistance measurement.

Each of the first set of printing elements may be adjacent to a respective one of the second set of printing elements within the array.

This method ensures that no printing elements are left untested, while ensuring that by the time adjacent printing elements are tested, sufficient time has passed for any heating effects of the first test to have dissipated.

According to a fifth aspect of the invention there is provided a method of determining the resistance of a printing element of a print head, the print head comprising a plurality of individually controllable printing elements connected in parallel, and a capacitor connected in parallel with the printing elements, the method comprising: connecting one of the printing elements to a test voltage; waiting for a predetermined time period; measuring, by a current monitor, the current drawn by the printing element from the test voltage, wherein the current monitor has a lower resistance than the resistance of a printing element; and determining the resistance of the printing element based upon the measured current.

According to a sixth aspect of the invention there is provided a method of determining a property of a printhead comprising a plurality of individually controllable printing elements, the method comprising: identifying a plurality of functional printing elements provided by the printhead; and determining the property of the printhead based upon the identified plurality of functional printing elements.

Determining a property of the printhead by identifying a plurality of functional printing elements avoids the need to rely on user input to identify the property of the printhead, obviating possible negative consequences of user error. For example, where the property is a printhead width and a user inputs an incorrect (too narrow) printhead width a printer may be unable to print at a full width, reducing the effective capability of the printer. Alternatively, the printer may print a corrupted or distorted image. In a further alternative, where a user inputs an incorrect (too wide) printhead width, a printer may attempt to print using printing elements of the printhead which are not present, possibly causing images to be only partially printed.

The property may be a dimension of the printhead. The dimension may, for example, be a width of the printhead. Printheads may be provided in a number of different standard sizes, each having a different width, and a correspondingly different number of printing elements. By determining the number of printing elements, it is possible to determine the width of the printhead. For example a printhead may be provided in either 53 mm or 107 mm width options, having 640 printing elements and 1280 elements respectively.

The printhead may be provided with printing elements arranged in a one-dimensional array. A dimension in which the one-dimensional array extends may be considered to be a dimension of the printhead.

Identifying said plurality of functional printing elements may comprise: generating a plurality of control signals; applying each control signal to the printhead; monitoring a response of a circuit to the application of each control signal; and determining whether a functional printing element is associated with a respective control signal based upon the respective response of the circuit.

By generating and applying control signals to a printhead corresponding to a predetermined number (e.g. a maximum number) of printing elements which may be provided by the printhead, it is possible to identify whether the printhead does indeed provide the predetermined number of printing elements, or some smaller number of printing elements. Where a printing element is controlled by a control signal, a response may indicate that the printing element is present. However, where a control signal is provided for a printing element which is either not present, or not functional, a different response may be generated, allowing the present (and functional) printing elements to be identified.

Said plurality of control signals may define a set of control signals and determining the property of the printhead may be based upon which of the control signals in the set are determined to be associated with functional printing elements.

Determining the property of the printhead may be based upon identification of a predetermined subset of control signals in the set of control signals which are not associated with functional printing elements.

The set of control signals may be a logical sequence of control signals and determining the property of the printhead may be based upon positions of control signals in the logical sequence determined to be associated with functional printing elements.

Said predetermined subset of control signals in the logical sequence may be contiguous within the logical sequence.

Determining the property of the printhead may be based upon spatial locations of the identified functional printing elements.

Where there are no functional printing elements within a particular spatial location, it may be determined that the printhead does not provide any printing elements in that spatial location. For example, where there are no functional printing elements above a position in the logical sequence, it may be determined that printhead does not extend beyond that position.

Determining the property of the printhead may comprise selecting a property from a predetermined list of printhead properties.

The predetermined list of printhead properties may comprise a predetermined list of printhead dimensions, each printhead dimension having an associated number of printing elements.

The selected property may be the smallest dimension of the predetermined list which has an associated number of printing elements greater than or equal to the position in the logical sequence of the highest functional printing element.

Where position in the logical sequence of the highest functional printing element is not the same as one of the dimensions in the predetermined list, it may be assumed that at least some of the non-functional printing elements are defective printing elements (rather than not present). In that case, the smallest dimension of the predetermined list which has a number of printing elements greater the position in the logical sequence of the highest functional printing element can be selected, with the assumption being that any printing elements between the position of the highest functional printing element and the selected dimension are defective.

Said response of a circuit may be based upon a property of a printing element associated with a respective control signal. The property may be electrical resistance.

Determining whether a functional printing element is associated with a respective control signal may be based upon the response of the circuit and an expected response of the circuit.

The expected response of the circuit may be based upon an expected resistance value of a printing element. The expected response of the circuit may be based upon a nominal resistance value of a printing element. The expected response of the circuit may be based upon a resistance value within a predetermined range, or above or below a predetermined threshold value.

The printer may be capable of addressing a number of printing elements which is greater than or equal to the number of printing elements provided by the printhead.

The method may further comprise: addressing each of the identified functional printing elements; and determining a value indicative of the resistance of each of the identified functional printing elements.

Said addressing and said determining may be carried out when a predetermined criterion is satisfied.

The predetermined criterion may be selected from the group consisting of: the expiry of a predetermined period of time, and the completion of a predetermined number of printing operations, since the determination of the number of printing elements provided by the printhead.

The number of functional printing elements may be determined when the printer is powered on. The resistance of each of the identified functional printing elements may then be determined at various times subsequently, with only those printing elements which were determined to be functional needing to be tested at each subsequent time.

Determining a value indicative of the resistance of each of the plurality of printing elements may comprise a method according to the third aspect of the invention.

The sixth aspect of the invention may be carried out in conjunction with a method according to any or all of the third, fourth and fifth aspects of the invention. Furthermore, the sixth aspect of the invention may be carried out in conjunction with an apparatus according to the first or second aspects of the invention.

According to a seventh aspect of the invention there is provided a thermal transfer printer comprising: first and second spool supports each being configured to support a spool of ribbon; and a ribbon drive configured to cause movement of ribbon from the first spool support to the second spool support; and a printhead, the printhead comprising a plurality of individually controllable printing elements, and being configured to selectively transfer ink from the ribbon to a substrate, the printhead being moveable towards and away from a printing surface, during printing; the printer being configured to: identify a plurality of functional printing elements provided by the printhead; and determine a property of the printhead based upon the identified plurality of functional printing elements.

The printer may be capable of addressing a number of printing elements which is greater than or equal to the number of printing elements provided by the printhead.

The thermal transfer printer may be configured so as to have any of the features described above with reference to any of the other aspects of the invention.

More generally, it will be appreciated that any feature described with reference to one aspect of the invention may be combined with other aspects of the invention, and with features described with reference to any other aspect of the invention.

Embodiments of the invention will now be described, by way of example only, with reference to the accompanying drawings, in which.

Figure 1:
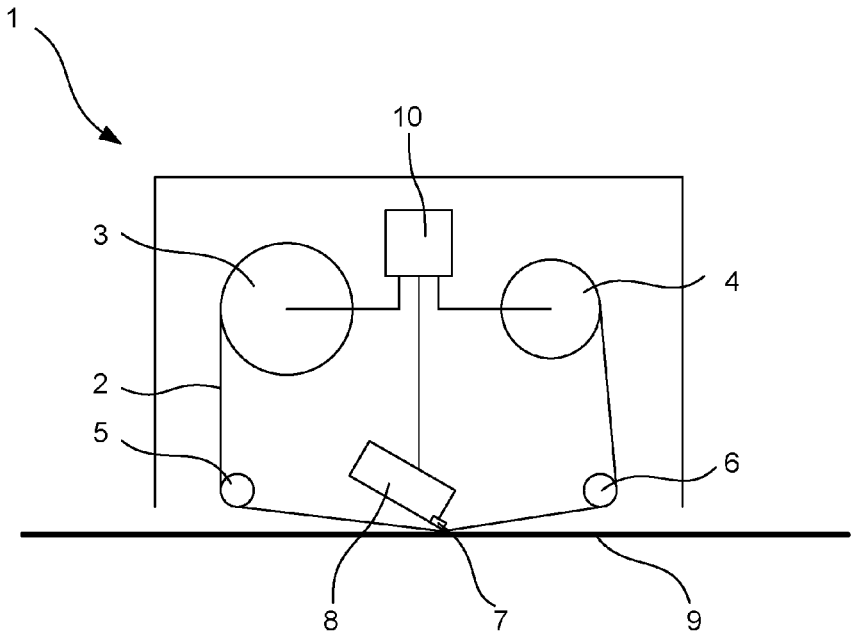
FIG. 1 is a schematic drawing of a thermal transfer printer according to an embodiment of the invention.

Referring to FIG. 1, a thermal transfer printer 1 comprises an ink carrying ribbon 2 which extends between two spools, a supply spool 3 and a takeup spool 4. In use, ribbon 2 is transferred from the supply spool 3 to the takeup spool 4 around rollers 5, 6, past a thermal print head 7. The rollers 5, 6 may be idler rollers, and serve to guide the ribbon 2 along a predetermined path. The print head 7 is mounted on a print head carriage 8. The ribbon 2 is driven between the supply spool 3 and the takeup spool 4 under the control of a controller 10. The ribbon 2 may be transported between the supply spool 3 and the takeup spool 4 in any convenient way. One method for transferring ribbon is described in our earlier patent, U.S. Pat. No. 7,150,572, which is hereby incorporated by reference.

In a printing operation, ink carried on the ribbon 2 is transferred to a substrate 9 which is to be printed on. To effect the transfer of ink, the print head 7 is brought into contact with the ribbon 2. The ribbon 2 is also brought into contact with the substrate 9. The print head 7 may be caused to move towards the ribbon 2 by movement of the print head carriage 8, under control of the controller 10. The print head 7 contains printing elements 11, which, when heated, whilst in contact with the ribbon 2, cause ink to be transferred from the ribbon 2 and onto the substrate 9. Ink will be transferred from regions of the ribbon 2 which correspond to (i.e. are aligned with) printing elements 11. The use of an array (for example a linear array) of printing elements can be used to effect printing of an image on a substrate by selectively heating printing elements 11 which correspond to regions of the image which require ink to be transferred, and not heating printing elements 11 which require no ink to be transferred.

A two dimensional image may be printed by printing a series of lines, the printing of each line being referred to as a printing operation. Different printing elements within the array may be heated during the printing of each line (i.e. during each printing operation). Between the printing of each line, the print head 7, ribbon 2, and substrate 9 are moved with respect to each other, such that the line printed on the substrate 9 from one printing operation is adjacent to the line printed by the next printing operation. For example, a barcode may be printed on a substrate by printing multiple lines, each of which provides a cross section of the whole barcode. Printing elements and regions of the printed image may be referred to as pixels.

Figure 2:
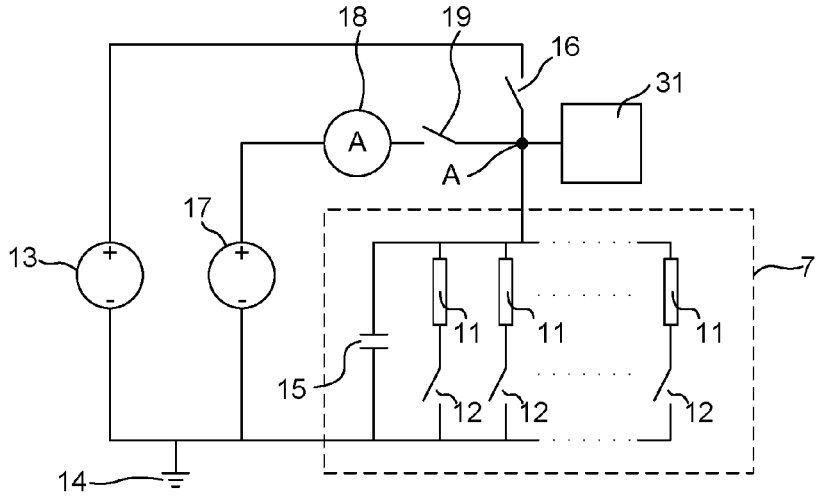
FIG. 2 is a schematic drawing of a circuit according to an embodiment of the invention which may be used in the printer of FIG. 1.

FIG. 2 shows a circuit according to an embodiment of the invention, including the print head 7 shown in FIG. 1. The print head 7 comprises an array of printing elements 11. The printing elements 11 are connected in parallel to one another. Each printing element 11 comprises a resistive heating element, which can be selectively energised by the closing of a respective switch 12, connecting the respective printing element 11 to a ground 14. The node A represents an electrical connection between the print head 7 and the printer 1 in which the print head 7 is installed. In use, a printing voltage supply 13 is connected to node A, providing a printing voltage. When one of the switches 12 is closed, a current will flow from the printing voltage supply 13 through a respective printing element 11 to ground 14.

The switches 12 are controlled by controller 10 to energise the printing elements 11, in a coordinated manner so as to print an image on substrate 9. The switches 12 may be implemented as transistors. For example, the switches may be field effect transistors or bipolar junction transistors.

The ground 14 may be a local ground, and may not in fact be connected directly to universal ground. The ground 14 merely provides a common reference against which voltages (such as the printing voltage) in the circuits described herein are defined.

The current flowing through the printing elements 11, when connected to the printing voltage supply 13 and to ground 14, causes the resistive heating elements to generate heat. If one of the printing elements 11 is in contact with an ink ribbon when heated, then the ink ribbon will be heated, causing the ink to melt and to be transferred to the substrate 9. The printing elements 11 being connected in this way to the printing voltage supply 13 will be referred to herein as the printing elements 11 being energised.

The print head 7 further comprises a capacitor 15 connected in parallel with the printing elements 11. That is, the capacitor 15 is connected between node A and ground 14. The capacitor 15 provides a reservoir of charge such that when a printing element 11 is energised current can immediately flow in the printing element. The capacitor 15 reduces the requirements on print voltage supply 13, and provides increased voltage stability, allowing uniform and predictable printing performance.

The printing voltage supply 13 is connected to node A through a switch 16. The switch 16 allows the printing voltage supply 13 to be selectively connected to or disconnected from the node A, and consequently allows the print head 7 to be electrically isolated from the printing voltage supply 13, when required. The switch 16 may be implemented as a transistor, such as, for example a field effect transistor or a bipolar junction transistor.

The print head 7 is a standard component which can be removed from printer 1. The resistance of each of the printing elements within a print head may be specified by the manufacturer as having a nominal value with a range of acceptable values. For example, a printing element may have a nominal resistance value of 1265 ohm (Ω) with an expected variation of less than ±15% of that value. Therefore, in normal operation, a printing element may be expected to have a resistance of between 1075Ω and 1455Ω. A printing element having a resistance value outside of this range might be considered to be defective. Measuring the resistance of a printing element can therefore be seen to represent a way of assessing the health of a print head.

The printing elements 11 are generally similar. The characteristics of the all of the printing elements 11 are similar. However, it may be that the specific characteristics of each printing element 11 are different. For example, while each of the printing elements may be said to have a nominal resistance of 1265Ω, there may be some variation between individual printing elements 11.

The capacitor 15 has a nominal capacitance, as specified by the manufacturer of the print head 7. A typical capacitance value for the capacitor 15 is 22 μF.

Calculations described below are based on the values of the components of an example print head as specified above although these can be straightforwardly altered to take into account any change in print head component values.

In normal printing operations, the voltage supplied by the printing voltage supply 13 may be, for example, 24 V. The power dissipated by a printing element can therefore be calculated by:

$$P_{print}=V_{print}^2/R_{nominal} \quad (2)$$

where;

$P_{print}$ is the power dissipated by the printing element during a printing operation, $V_{print}$ is the voltage supplied by the printing voltage supply; and $R_{nominal}$ is the nominal resistance of the printing element.

This equation can be used to calculate that the power dissipated by each energised printing element in a printing operation, where $V_{print}$ is 24 V and $R_{nominal}$ is 1265Ω, is around 0.455 W.

It will be appreciated that printing requires repeated energisations of the printing elements, perhaps many times, or even many thousands of times per second. This repeated use can damage the printing elements, perhaps causing the resistance of a printing element to increase. Alternatively, the resistance of a printing element may decrease with repeated use, for example if the printing element is short-circuited.

In order to measure the resistance of a printing element, it is necessary to perform some kind of controlled measurement of a property of a circuit in which the printing element is connected.

In a measurement process according to an embodiment of the invention, between printing operations, when the print head is idle, the switch 16 is opened to disconnect node A (and the print head 7) from the print voltage supply 13. During printing operations the capacitor 15 will be charged to the voltage level of the print voltage (e.g. 24 V), and will remain at this voltage unless discharged.

A test voltage supply 17 is then connected to the node A. The test voltage supply supplies a test voltage which is lower than the printing voltage. The test voltage may be around 8 V. The test voltage supply is connected to node A through a switch 19. The switch 19 may be implemented as a transistor, such as, for example a field effect transistor or a bipolar junction transistor. The node A is connected to an input of an analog to digital converter (ADC 31). The ADC 31 monitors the voltage at the node A.

With the test voltage supply 17 connected to node A, one of the printing elements 11 to be tested is connected to ground 14, via a respective one of the switches 12, and a period of time is waited for the current flowing from the test supply to stabilise. Once stable, the current drawn by the printing element 11 from the test voltage supply 17 is measured by an ammeter 18. The ammeter 18 may take any convenient form, providing an output indicative of the current drawn from the test voltage supply 17, while presenting a low resistance path through which the current can flow to node A from the test voltage supply 17. The measured current can then be used to calculate the resistance of the printing element 11, the resistance being found by the relationship R=V/I, where V is the voltage across the printing element 11 (i.e. the voltage difference between the node A and the local ground 14) and I is the measured current. The voltage across the printing element 11 is known from the voltage applied from the test voltage supply 13. The voltage across the printing element may also be measured, as described in more detail below.

The stabilisation of the current flowing through the printing element 11 can be considered in two distinct phases. In a first phase the voltage at the node A is reduced from the printing voltage (e.g. 24 V) to the test voltage (e.g. 8 V). The current flowing through the printing element 11 is not measured during the first phase. The voltage reduction in the first phase (phase one) is described in more detail below with reference to FIG. 3.

In a second phase (phase two), with the voltage being substantially at the test voltage, the current is further allowed to stabilize to an acceptable extent. Measurement of the current flowing through the printing element 11 is performed after the second phase.

The use of a low resistance current measuring apparatus (ammeter 18) ensures that the measurement time associated with the printing element 11 in the second phase is short, and that any fluctuation in current flowing through the ammeter 18 to the printing element 11 is stabilised to an acceptable extent within an extremely short period of time.

In the first phase, before a first one of the printing elements 11 can be tested, the voltage across the capacitor 15 should be controlled to be at the level of the test voltage supply 17 (e.g. 8 V). If the print head 7 has previously not been in use (i.e. the measurement is carried out on a newly installed print head 7, or in a recently activated printer 1), then the capacitor 15 can be charged to the level of the test voltage supply from the test voltage supply 17. In this case, then a first current measurement should be taken after rather more than a single RC time constant has elapsed. It may be necessary to allow 10 or more RC time constants (1 ms, or more) to pass before taking a first current measurement.

Alternatively, if the print head 7 has been in use, and the capacitor 15 is charged to the level of the print voltage supply 13 (e.g. 24 V), then the capacitor 15 should be discharged to the level of the test voltage supply 13 (e.g. 8

V) before measurements are taken. While the test voltage supply 17 is illustrated in FIG. 2 as being connected to the node A and capacitor 15 by a simple switch 19, a practical circuit may instead be implemented with a blocking diode, preventing the higher printing voltage (e.g. 24 V) from being discharged to the test voltage supply 17. In this case, the switch 19 may be omitted.

Figure 3:
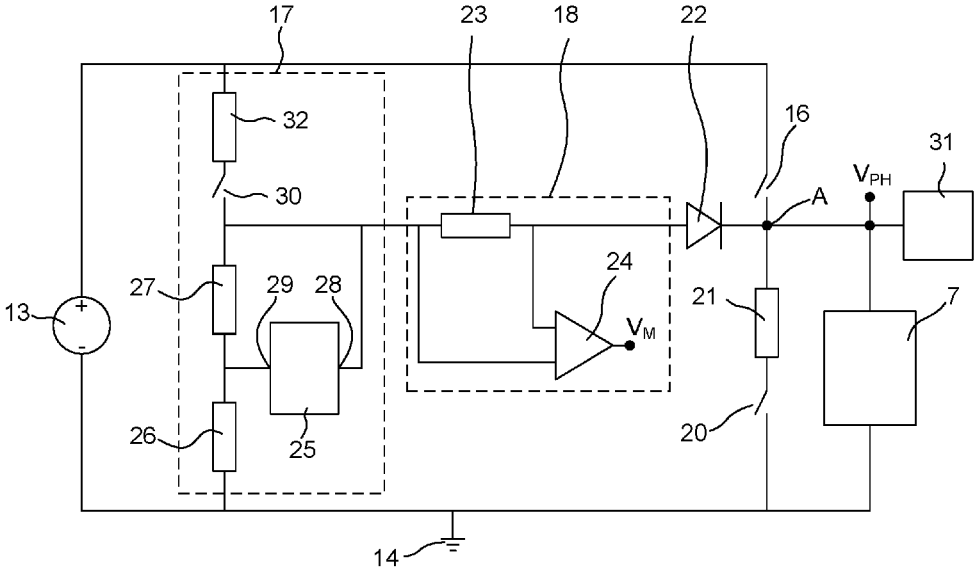
FIG. 3 is a schematic drawing of part of the circuit of FIG. 2 in more detail.

FIG. 3 illustrates, in more detail some of the components shown in FIG. 2. Furthermore, FIG. 3 includes some additional circuit components which were omitted from the circuit of FIG. 2 for clarity. The test voltage supply 17 and ammeter 18 are shown in FIG. 3 consisting of several components, while a print head discharge circuit is also provided. The operation of these components will now be described in more detail.

A print head discharge circuit is provided to allow the printing voltage to be discharged to the level of the test voltage supply (or lower). This provides a safe method of discharging the capacitor 15 since the alternative of connecting one or more of the printing elements 11 to the node A to discharge the capacitor 15 is not feasible without risking damage to the print head heating elements as this would exceed each the maximum energy level allowed for each of the printing elements 11. The discharge circuit comprises a discharge switch 20 coupled to ground 14. A discharge resistor 21 is provided to limit the instantaneous current which flows through the discharge switch 20. The switch 20 may be implemented as a transistor, such as, for example a field effect transistor or a bipolar junction transistor.

The resistance of the discharge resistor 21 is chosen to allow a relatively short discharge time of say 10 ms without dissipating excessive power and also allowing use of a relatively low current capability discharge transistor or switch. For example, a resistance value of 470Ω would provide an RC time constant of around 10 ms if used with a typical print head capacitor 15 having a capacitance of 22 μf.

The duration of phase one is thus determined by an RC time constant $T_{disch}$ associated with the discharge circuit. The duration of phase one may for example be just the discharge time constant $T_{disch}$, since the voltage has to discharge only by approximately two-thirds (typically from 24 V down to the test voltage of around 8 V). The total print head element test duration is determined by the duration of phase one, and multiple durations of phase two, the multiple depending on how many printing elements are tested.

The voltage across the capacitor 15 (and also printing element 11 to be tested) can be optionally monitored during discharge to prevent the capacitor 15 being discharged below a voltage level required for subsequent testing. The node A of the print head 7 is connected to the input of the analog to digital convertor (ADC 31) which produces a digital output proportional to the voltage level measured. Node A of the print head 7 may be connected to the input of the ADC 31 via an amplifier (not shown), to ensure an appropriate signal is received by the ADC 31.

The ammeter 18 is described above as providing an output indicative of the current drawn from the test voltage supply 17, while presenting a low resistance path through which the current can flow to node A from the test voltage supply 17. In a practical circuit, the ammeter 18 may take the form of a current to voltage converter.

The ammeter 18 may be implemented as shown in FIG. 3. The test voltage supply 17 is connected to a blocking diode 22, and node A of print head 7 through a sense resistor 23. The blocking diode 22 prevents higher voltages, which may be present at the node A, by virtue of charge stored in the print head capacitor 15, or indeed the connection of the node A to the print voltage supply 13, from being connected to the sense resistor 23.

The sense resistor 23 is selected so as to have a small but accurately known resistance value. For example, a 4.7Ω resistor with ±0.1% tolerance may be selected. This extremely high accuracy ensures that the voltage generated across the sense resistor 23 is precisely proportional to the current flowing through the sense resistor 23, the blocking diode 22 and the print head 7.

In use, with current flowing through the sense resistor 23, some voltage will develop across the sense resistor 23. The variation of this voltage is measured to indicate changing current levels. However, the small resistance of the sense resistor 23 (e.g. 4.7Ω) ensures that the voltage drop across the sense resistor 23, and any change therein, is negligible with respect to the voltage drop across the printing element 11 (having a resistance of e.g. 1265Ω). For example, if a test voltage of 8 V is used, across the series combination of the sense resistor 23 and the printing element 11, then the voltage dropped across the sense resistor 23 will be just 30 mV, compared to 7.97 V dropped across the printing element 11. This represents less than 0.4% of the total voltage drop, and allows sensitive measurement of the current flowing through the printing element 11, without the sense resistor 23 materially affecting the total resistance of the circuit.

During testing of a printing element 11, after phase one (when the voltage at the node A is reduced to the test voltage) one of the printing elements 11 is connected to ground 14. Immediately after the instant that the printing element 11 is connected, the print head capacitor 15 will provide all of the current to the printing element 11. This is because at the instant of closing the switch 12 there is no current flowing from the test voltage supply 17 through the sense resistor 23 since the print head capacitor 15 is fully charged to the test voltage (8V). There being no current flowing through the sense resistor 23 means that there will be no voltage drop across the sense resistor 23 according to ohms law. However, once the switch 12 is closed, and the printing element 11 is connected, the sense resistor 23 and the printing element 11 form a potential divider, reducing the voltage at the node A to approximately 7.97 V (as described above).

It will be appreciated that blocking diode 22, when forward biased as will be the case during print head test measurements, will also cause some voltage drop. However, the blocking diode 22 voltage drop will be highly non-linear and largely constant across the range of currents which will be expected to be measured in test operations. The voltage drop across the blocking diode 22 may for example be approximately 0.2 V for a wide range of current levels. The voltage drop across blocking diode 22 would only change substantially if a current change of several orders of magnitude was experienced which would not be expected to occur in normal use conditions. However the current drop across the blocking diode 22 may also vary if there is an ambient temperature change. Therefore, in order to eliminate any errors due to variation in this diode voltage drop the voltage across the print head 7 is monitored using the ADC 31 and this voltage measured is used in the calculation of the resistance of the printing elements 11.

To monitor the voltage across the sense resistor 23 an amplifier 24 is used. The amplifier 24 may, for example, be a precision current sensing amplifier, such as the LMP8602MM manufactured by Texas Instruments. The amplifier 24 provides a high precision fixed gain amplification of small differential input signals (i.e. the 30 mV developed across the sense resistor 23) in the presence of relatively large common mode signals (i.e. the 8 V test voltage).

The output $V_M$ of the precision current sensing amplifier 24 is a voltage level which is 50 times the differential input voltage in the case of a LMP8602MM device being selected. Alternative amplifiers may have different fixed or variable gains. A gain of 50 results in an output voltage of around 1.5 V for an input signal of around 30 mV. The output voltage may be passed through a further amplifier, such as a unity gain buffer amplifier, before being presented to the input of a second analog to digital converter (not shown), and to the input to the controller 10. The controller 10 may store the input voltage level, and subsequently perform calculations to determine the printing element resistance to which it relates based on the well known relationship V=IR.

The use of a precision current sensing amplifier such as the LMP8602MM, as described above, permits a precise measurement of the current flowing to printing element 11 with only a single further precision component being required (sense resistor 23). The precise fixed gain of the amplifier is achieved without the need for the specification of several high precision external components.

In an alternative embodiment, a differential amplifier may be implemented using discrete components in combination with an operational amplifier.

Figure 4:
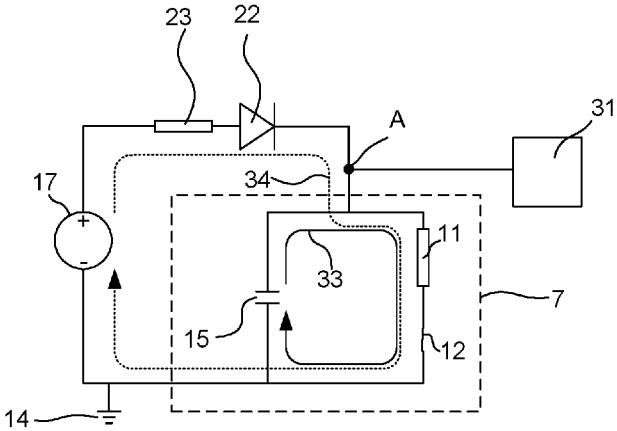
FIG. 4 is a schematic drawing of part of the circuit of FIG. 2 in more detail.

Referring now to FIG. 4, the detail of the operation of the printing element test circuit at the instant one of the printing elements 11 is connected to the ground 14 by the switch 12 is described. FIG. 4 shows a simplified circuit having the same components as the circuit of FIG. 3, with some components omitted for clarity. The switch 12 is shown in a closed configuration.

It is assumed, for the purposes of explanation, that the blocking diode 22 has a substantially constant voltage drop across it. However, as described above, it will be appreciated that the well-known dependence of the diode characteristic on temperature may be used to calculate an accurate value of the voltage drop where temperature variation is expected.

At the instant that the switch 12 is closed, the voltage at the node A will be referred to as $V_0$.

When the switch 12 is closed the capacitor 15 will be discharged from $V_0$, through the printing element 11, to a slightly lower voltage determined by the potential divider formed by the sense resistor 23 and the resistance of the single printing element 11 as described above. The discharge time will be determined by the RC time constant of the print head capacitor 15 and the printing element 11 (it should be noted that the capacitor discharge current cannot flow through the reverse biased blocking diode 22).

The initial capacitor discharge when the switch 12 is closed is illustrated by current path 33 and may be described by equation (1) above. Equation (1) can be rearranged to:

$$\frac{V_0}{V(t)} = e^{\frac{t}{RC}} \tag{3}$$

To calculate a time T taken to discharge to a particular voltage level $V_1$, from a known starting point $V_0$ equation (3) can be used. The voltage at a time t (V(t) in equation (3)) is replaced with the voltage $V_1$. The variable time t is replaced with the time to be calculated T. Natural logarithms are also taken of both sides of equation (3) giving:

$$\ln\left[\frac{V_0}{V_1}\right] = \frac{T}{RC} \tag{4}$$

Which can be rearranged to give:

$$T = RC\left(\ln\left[\frac{V_0}{V_1}\right]\right) \tag{5}$$

As noted above, once the switch 12 has been closed, the voltage at the node A will be governed according to the relative resistances of the sense resistor 23 and the resistance of the printing element 11. The voltage $V_1$ to which the node A will stabilize, is therefore given by:

$$V_1 = V_0\left[\frac{R_{11}}{R_{11} + R_{23}}\right] \tag{6}$$

where:

$R_{11}$ is the resistance of the printing element 11; and $R_{23}$ is the resistance of the sense resistor 23 (i.e. the internal resistance of the ammeter 18).

Substituting equation (6) into equation (5) gives an expression for the time taken to discharge the capacitor 15 from the initial voltage $V_0$ to the voltage $V_1$ which is dropped across the printing element 11 during current measurement, in terms of the resistances of the resistors 11, 23 and the capacitor 15:

$$T = R_{11}C_{15}\ln\left[\frac{R_{11} + R_{23}}{R_{11}}\right] \tag{7}$$

where:

$C_{15}$ is the capacitance of print head capacitor 15.

Substituting into equation (7) the values described above for the various components allows the time taken for the printing element voltage to stabilise to be calculated. Assuming the ammeter 18 has an internal resistance (sense resistor 23) of, for example, 4.7Ω, and the printing element resistance and print head capacitance are 1265Ω and 22 μF respectively, the discharge time T is approximately 103 microseconds according to the formula given in equation (7).

This is significantly less than a single time constant of the RC combination of one of the printing elements 11 and the capacitor 15 (RC=28 ms, as described above). The addition of the low resistance connection to the test voltage supply 17 (the connection being made by the ammeter 18) provides a dramatic improvement in the stabilization time, and hence the response time of the capacitor 15 to fluctuations in current or voltage.

In phase one (described above) it can be seen that until the voltage across capacitor 15 has reduced to the level of the test voltage supply 17 current will not flow through the ammeter 18. However, once the start of phase two has been reached, for example after the time $T_{disch}$ (or around one $R_{21}C$ time constant, where $R_{21}$ is the resistance of the discharge resistor 21 and C is the capacitance of the print head capacitor 15, as described above) has passed, then the voltage level across the capacitor 15, and hence voltage level across the printing element 11 will reach a stable level according to the stabilization time T, as calculated by equation (7) above.

Once it is established that the voltage at node A is stable (for example by measuring the voltage at node A using the ADC 31), the current drawn from the test voltage supply 17 will represent the current flowing through the printing element 11, as illustrated by current path 34

After a first one of the printing elements 11 is tested, a second one of the printing elements 11 can be tested. A first one of the switches 12, associated with the first one of the printing elements 11 is opened, disconnecting the first one of the printing elements 11 from the ground 14. When no print head switches 12 are closed the voltage across the print head capacitor 15 will begin to rise back to the initial test voltage $V_0$. This voltage rise will be controlled by the time constant of the sense resistor 23 and the print head capacitor 15. This time constant is typically around 100 μs ($R_{23}$=4.7 ohms, $C_{15}$=22 μF). Therefore the settling time for this voltage increase will be even shorter than that associated with the discharge from 8 V to 7.97 V, as described above with reference to equation (7).

In normal testing operation a few microseconds after the first one of the switches 12 is opened, a second one of the switches 12 (associated with the second one of the printing elements 11) is closed, connecting the second one of the printing elements 11 between the test voltage supply 17 and the ground 14. In this short time therefore the voltage across the print element will only charge by less than a single millivolt, this change being insignificant.

That the voltage across the capacitor 15 is stable at substantially the voltage level supplied by the test voltage supply 17 (less the 30 mV dropped across sensing resistor 23 and 0.2 V across blocking diode 22) ensures that there is no significant capacitor charging or discharging required to test subsequent printing elements, i.e. no need to repeat phase 1. Therefore if the second one of the switches 12 is switched on shortly after the first switch 12 is switched off, the current flowing through the ammeter 18 to the second printing element to be tested stabilises quickly. Even if a significant period of time is allowed between the testing of printing elements 11, the maximum time required for settling will be 103 microseconds, as calculated above.

It is therefore possible to measure the current flowing through the second one of the printing elements 11 after a much shorter time than the time taken to measure the first one of the printing elements 11. A testing period for the second and each subsequent one of the printing elements 11 of around 100 μs can be achieved.

This method allows the voltage at node A to be kept substantially constant between testing operations. This small change in voltage between testing operations allows testing operations to be repeated after only 100 μs or so (i.e. just phase two). However, in known alternative printing element testing methods, significant voltage changes are caused between testing printing elements. This requires that a far longer time period is required between measurements to ensure that voltage and current levels have stabilised (i.e. repeating phase one and phase two for each measurement). The reduction in time associated with taking sequential measurements outlined above allows the method described to be used to measure the resistance of a large number of printing elements in a short period of time. For example, if one measurement takes around 100 μs (T), then after the initial voltage has been adjusted in phase one, testing all 1280 printing elements within a print head could take just a further 128 ms.

In order to allow the ADC 31 to read a stable voltage across the sense resistor 23 and at the node A between successive tests, a time of, for example, 200 μs may be allowed before each reading. Alternatively, or additionally, more than one reading can be taken for each voltage measurement to allow for averaging. This also enables it to be checked whether the current flowing from the test supply 17 has stabilized. In this way, a measurement of the current flowing through the sense resistor 23 can be delayed until a stable reading is detected by the ADC 31.

Therefore, allowing for a far more conservative estimate of the time required for the current level to stabilise, for example two times the settling time T, then the time required for each measurement is increased to around 200 μs, and the total print head test time, after phase one, is increased to around 256 ms. This is still an improvement of well over 100 with respect to other known methods, with the increased settling time allowing a more accurate current measurement to be taken, with any transient currents likely to have significantly subsided.

The test voltage supply 17, providing the test voltage may be implemented using a precision voltage reference 25, such as, for example a TL431 manufactured by Texas Instruments. The TL431 is a programmable voltage reference device which allows a reference voltage to be set by the selection of resistors, and provides a low output resistance of just 0.2Ω meaning that the voltage does not change significantly regardless of how much current is drawn from the output. The TL431 device further offers a highly stable output reference voltage over a large temperature range.

The voltage reference 25 is arranged with two resistors 26, 27 which set the output voltage. The voltage reference circuit described is a simple 'shunt' regulator and is therefore supplied with sufficient current so that it will always shunt current through itself in order to regulate the output voltage, even with a maximum load current being drawn. This current is set by a resistor 32 in series with a switch 30. The resistor 32 is an 820 ohm resistor. The voltage reference 25 is operative to maintain the voltage at an output 28 at a level necessary to maintain the voltage at a reference input 29 at a predetermined value. The voltage at the output 28 is provided to a potential divider formed from the resistors 26, 27. The voltage at the intermediate node of the potential divider (i.e. between the resistors 26, 27) is fed back to the reference input 29. The TL431 device operates with a reference input 29 of approximately 2.5 V. The voltage at output 28 is adjusted to keep the voltage at the intermediate node of the potential divider at 2.5 V. The voltage at output 28 is therefore given by the ratio of the resistors 26 and 27, as shown below:

$$V_{out} = V_{ref} \times \frac{R_{26} + R_{27}}{R_{26}} \tag{9}$$

where:

$V_{out}$ is the voltage at output 28;

$V_{ref}$ is the voltage at reference input 29 (e.g. 2.5 V);

$R_{26}$ is the resistance of the first input resistor 26 (e.g. 13 kΩ); and $R_{27}$ is the resistance of the second input resistor 27 (e.g. 30 kΩ);

The example component values above (13 kΩ, and 30 kΩ) result in an output voltage $V_{out}$ of around 8.3 V. This voltage level will result in a test voltage, taking into account the voltage dropped across blocking diode 22, of around 8.1 V being delivered to node A during testing operations.

In alternative embodiments, any suitable reference voltage may be selected by varying the resistor values or voltage reference component. Moreover, a test voltage of around 8 V may be achieved with a number of different voltage reference arrangements.

The power may be supplied to voltage reference 25 from a power supply such as the print voltage supply 13. The print voltage supply provides current to the voltage reference 25 through the switch 30 and the resistor 32. The switch 30 is operative to provide isolation of the voltage reference 25 from the print voltage supply 13 when printing (rather than printing element testing) is underway. The switch 30 is operated under the control of the controller 10. The switch 30 may be implemented as a transistor, such as, for example a field effect transistor or a bipolar junction transistor.

Alternative reference voltage devices, such as, for example, Zener diodes, may be used instead of the precision voltage reference device described above.

During normal print use, a software routine running on controller 10 may be configured to run a printing element test. For example, when the printer is expected to be idle for a prolonged period of time, it may be activated in a print head test mode. First, the print voltage supply 13 is disconnected from node A by the opening of switch 16, then switch 30 is closed, connecting voltage reference 25 to the print voltage supply 13. The print head capacitor 15 is discharged though the resistor 21 (under the control of switch 12 and discharge switch 20 respectively). This is phase one. Once the output of the voltage reference 28 has stabilised, and the charge on the capacitor 15 reduced to an acceptable level, print head testing may begin.

The quiescent current flowing through sense resistor 23 is measured by amplifier 24, and fed into controller 10. The printing element 11 to be tested is then connected (by closing its respective switch 12) to node A, and, after a suitable time period (e.g. >100 μs) the current flowing through sense resistor 23 is again measured by amplifier 24, and fed into controller 10. The difference in current values (as indicated by a difference in voltage values, with a constant of proportionality given by the gain of amplifier 24 and the resistance of sense resistor 23) is then considered to be the current flowing through printing element 11.

It should be appreciated that the current flowing through the sense resistor 23 may include contributions from circuit components other than the printing element 11. The quiescent current drawn by various circuit components may for example reach several, or even tens of mA. For example, as described above, a comparator may be configured to monitor the print head voltage (i.e. voltage at node A). Any such comparator may have, at an input, a potential divider which may cause some quiescent current to be drawn. Similarly, there may be a switching circuit configured to control the print head voltage switch 16, which may draw some current. Therefore, a first current measurement is taken when the printing element 11 is not connected, and a second current measurement is taken when the printing element 11 is connected. The difference between the two current measurements can be attributed to the current flowing through the printing element 11. The current expected to be drawn by a healthy printing element ($R_{nominal}$=1265Ω) is 8.1/1265=6.4 mA.

The quiescent current measurement can be taken immediately before or after each test measurement. However, the quiescent current is likely to fluctuate slowly (for example with changes in ambient temperature), and therefore may be measured less frequently than the printing elements. For example, the quiescent current could be measurement after every 10 or 100 printing elements, or even once for an entire print head test.

The controller 10 has a plurality of inputs and outputs. The outputs are configured to control the various switches which control the operation of the printer 1, print head 7, and printing element test circuits described above. The switches 12 are operated under the control of the controller 10, although may not be provided with dedicated outputs from the controller 10. It will be appreciated that more or less outputs from controller 10 might be required for alternative circuit implementations. It will also be appreciated that controller 10 is not necessarily implemented as a single device. The functions and processes attributed to controller 10 may be carried out by a number of different devices which may each be ASIC, FPGA or programmable processors as appropriate. For example the interface with printing element control switches may be provided by a dedicated device located on the print head itself. Furthermore printer control operations, such as control of print head carriage 8, or ribbon 2 advance, may be controlled by a controller located in printer 1, while control of the printing element test control functions may, for example, be controlled by a controller located within the print head carriage 8.

An input which is indicative of the voltage level at node A of the print head 7 is provided to the controller 10. The node A of the print head 7 may be connected to the input of the ADC 31 which produces a digital output proportional to the voltage level measured. Node A of the print head 7 may be connected to the input of the ADC 31 via an amplifier (not shown), to ensure an appropriate signal is received by the ADC 31.

An input which is indicative of the current sensed at node A of the print head 7 is provided to the controller 10. The output of the amplifier 24 may be connected to the input of an analog to digital convertor (ADC 31) which produces a digital output proportional to the voltage level measured. The output of the amplifier 24 may be connected to the input of the ADC via an amplifier (not shown), to ensure an appropriate signal is received by the ADC.

Figure 5:
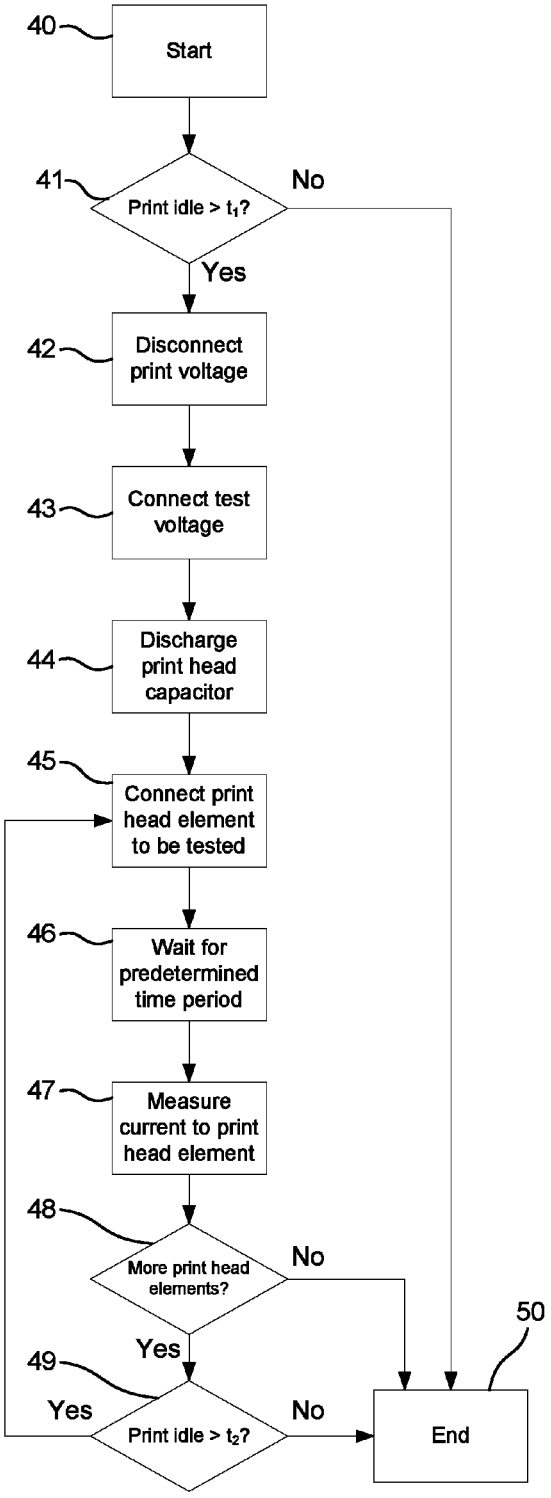
FIG. 5 is a flow chart illustrating a method according to an embodiment of the invention.

The method described above is further illustrated, and can be summarised with reference to FIG. 5. The print head test process is controlled by controller 10, and follows a series of processing steps. The process starts at step 40, with a software routine which is run periodically in the controller 10. Processing passes immediately to step 41.

At step 41, the controller 10 determines whether there is sufficient time to run a print head test routine. The time required to run a print head test routine is the time required for phase one in addition to the time required for phase two. For example, if a print instruction has been received then printing operations may be necessary within the subsequent 30 ms, and as such, there may be insufficient time to carry out a print head test process. If there is not determined to be sufficient time, then processing passes to step 50, where the processing is terminated. However, if there is determined to be sufficient time, then the processing passes to step 42. A time period $T_1$ can be specified which denotes the minimum time period required for carrying out a print head test process.

At step 42, the printing voltage is disconnected from the print head. This is accomplished by the opening of the switch 16. Processing then passes to step 43.

At step 43, the test voltage supply is activated by closing the switch 30. Processing then passes to step 44.

At step 44, the print head capacitor 15 is discharged and test voltage supply is activated by closing the switch 30. The print head capacitor may be discharged by closing switch 20 thus discharging the capacitor through resistor 21 until the voltage at point A is sensed to have reached the required test voltage as sensed through the ADC 31 input to the controller 10. Processing then passes to step 45.

At step 45, one of the printing elements 11 being testing is connected to node A, by closing a respective one of the switches 12. The printing element 11 is now connected to the test voltage supply 17 and is ready to be tested. Processing then passes to step 46.

At step 46, a predetermined time period $T_2$ is allowed to pass before measurements are carried out. The time period $T_2$ is calculated as a small fraction of the time constant (RC) of the printing element 11 and print head capacitor 15. The time period $T_2$ may be, for example 0.4% of the RC time constant (i.e. around 100 μs). After the time period $T_2$ has elapsed, processing passes to step 47.

At step 47, the current flowing through printing element 11 is measured by ammeter 18. The measurement may be carried out as a series of measurements, for example by sampling the output $V_M$ of the amplifier several times and taking an average value. The voltage at node A may also be measured at the same time as the current flowing through the printing element. This can provide for a more accurate resistance measurement. Processing then passes to step 48.

A further process step may involve sampling the current flowing through ammeter 15 before one of the printing elements 11 is connected to node A at step 45. If this step is performed, then the current measured is subsequently subtracted from the current sampled at process step 47.

At step 48, the processor 10 determines whether there are further printing elements to test. If there are further printing elements, processing passes to step 49. If not, then processing passes to step 50, where the processing is terminated.

At step 49, the processor 10 determines whether there is sufficient time to run a further printing element test. For example, if a print instruction has been received then printing operations may be necessary within the subsequent 1 ms, and as such, there may be insufficient time to carry out a further print head test process, in which case processing passes to step 50, and the processing is terminated. A time period $T_3$ can be specified which denotes the minimum time period required for carrying out a further print head test process.

Any testing operations should also take into account that there will need to also be time allowed for the print head capacitor 15 to be charged back up from the test voltage level to the normal printing voltage level in order to commence printing operations once more. This time may be limited by the speed at which the semiconductor switching device used for the switch 16 is allowed to fully switch on. This will be typically only a few ms, the main limitation being the requirement to limit the inrush current of the print head capacitor 15. The print head capacitor 15 could be damaged if the inrush current that is allowed to flow from the main print head printing power supply 13 is too high. The switch 16 is controlled by a hot swap controller chip LM5069MM-1 (not shown), which is configured to prevent current above a predetermined level from flowing into the print head 7. Alternative components may be used to control the switch 16.

If there is determined to be sufficient time, then the processing returns to process step 45, where a second printing element 11 is tested. The process will then follow the above process steps 45 to 49, until it is determined that either all printing elements have been tested, or that there is insufficient time to test further printing elements. It will be appreciated that the time required at process step 41 ($T_1$) to initiate the test process may be greater than the time required to test a further printing element at process step 49 ($T_3$). The discharging of capacitor 15 requires significantly longer time (phase one, e.g. 10 s of ms) than the testing of a single printing element (phase two, <<1 ms). These time periods can be adjusted to suit a particular system and time constants associated with it. The time period $T_1$ required at process step 41 may be selected to be, for example, greater than 30 ms. The time period $T_3$ required at process step 49 may be selected to be, for example, greater than 1 ms.

The process described above with reference to FIG. 4 illustrates an embodiment of the invention. However, it will be appreciated that alternative processing steps may be carried out, or illustrated processing steps carried out in a different order, in order to achieve the effect of the invention.

For example, the process may be started when a new print head is installed, or when a printer is switched on from an un-powered state. In either of these situations, it may not be necessary to disconnect the printing voltage, or to discharge the print head capacitance. The testing process described above may further be initiated at various intervals depending on the printing usage, or other external factors, such as, for example print quality requirements. The testing process may be initiated by a printer user.

An initial resistance reference value for each of the printing elements 11 will be stored in a memory of the controller 10. This initial resistance reference value will be measured when a new print head 7 is first used. The initial resistance reference value will be treated as being a 'good' resistance value, and subsequently measured values compared to that value.

In normal printing operations, a printing element, energised with a print voltage of 24 V, and having a nominal resistance of 1265Ω, will dissipate approximately 0.45 W.

However, under the test conditions described above, the same printing element will dissipate just ($P=V^2/R=8^2/1265=$) 0.05 W. It can be understood that excessive loading of the printing element should be avoided where possible, so as to prolong the life of the printing element. Therefore, the low power dissipation of energy within the printing element during testing (as described above) allows testing to continue without having any significant effect on the lifetime of a printing element.

Moreover, the reduced time periods associated with the above described printing element testing method (e.g. ~200 μs per printing element versus ~90 ms per printing element with some alternative methods) result in a reduced cumulative loading effect on printing elements during testing. For example, the method described above may cause 0.05 W to be dissipated for 200 μs per printing element, resulting in the dissipation of 10 μJ of energy per printing element tests. The known printing element test methods described above, even if using the reduced testing voltage of the present method, would likely cause (0.05 W×90 ms) 450 μJ of energy to be dissipated per print heat element tested. Notwithstanding the increased energy use associated with this alternative method, this will result in increased wear on printing elements under test.

It will be appreciated that during testing, albeit to a lesser extent than during printing, a printing element may become heated. This heating will also cause the region of the print head surrounding a first one of the printing elements 11 to become heated also. It will be appreciated that in a print head 7 in which an array of printing elements 11 are arranged adjacent to one another, a second one of the printing elements 11 may become heated during testing of the first one of the printing elements 11. While it may be expected that the resistance of a printing element is altered when at an elevated temperature, this effect can be accounted for when the elevated temperature is brought about by the resistive heating effect of that print heat element. However, where an elevated temperature is brought about by an external factor (e.g. the heating of an adjacent or proximate printing element), then any change in resistance caused by this temperature change may lead to incorrect resistance measurements being taken, and consequently incorrect conclusions being reached about the health of the respective printing element.

Therefore, to mitigate any negative effects associated with heating of adjacent printing elements, when sequentially testing a plurality of printing elements, the printing elements may be tested in a non-adjacent sequence. For example, print head test sequence may follow a pattern of testing every fourth printing element. Once every fourth printing element in a print head array has been tested (starting with the first element in the array, e.g. 1, 5, 9, 13, etc.), then every fourth printing element starting with the second may be tested (e.g. printing elements 2, 6, 10, 14 . . . ). In this way, it is possible to cycle through testing each of the printing elements 11 without testing adjacent printing elements consecutively, avoiding heating of one of the printing elements 11 affecting the resistance of another of the printing elements 11.

Figure 6:
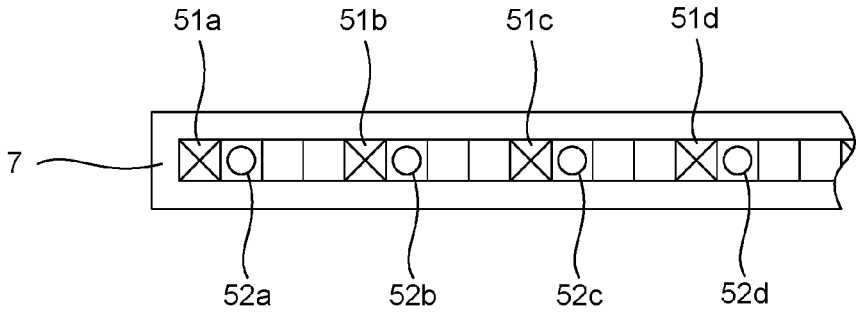
FIG. 6 is a schematic illustration of printing elements of a print head used in the printer of FIG. 1.

The process of testing printing elements is illustrated by FIG. 6, which shows a portion of the print head 7 having a large number of printing elements arranged in a linear array. The printing elements in the array are each printing elements 11. A first set of printing elements 51 are regularly spaced within the array, and arranged as the first printing element and every fourth printing element thereafter. A second set of printing elements 52 are also regularly spaced within the array, but arranged as the second printing element and every fourth printing element thereafter. It will be appreciated that each of the first set of printing elements 51 is adjacent to a respective one of the second set of printing elements 52. In an embodiment of the invention, each of the first set of printing elements 51 is tested in sequence (e.g. 51*a*, 51*b*, 51*c*, etc.) before each one of the second set of printing elements 52 is tested in sequence (e.g. 52*a*, 52*b*, 52*c*, etc.). It will be appreciated that following this sequence of testing (51*a*, 51*b*, 51*c*, . . . 52*a*, 52*b*, 52*c*, . . . ) ensures that adjacent printing elements (e.g. 51*a* and 52*a*) are never tested consecutively and that all of the printing elements can be tested in a systematic way.

It will be appreciated that variations of this method which achieve the same result could be accomplished, for example by testing different numbered multiple printing elements, until all elements, or a predetermined set of the printing elements had been tested.

When a resistance value has been calculated for a printing element, as described above, it is possible to perform a number of further actions.

For example, if it is established that a printing element is defective (i.e. it shows open circuit or short-circuit characteristics, or a resistance value outside some predetermined value range) then the controller may simply record that that printing element 11 is defective.

The controller 10 may further increment a counter stored within a software routine which stores a count of the number of printing elements within the print head which are defective. It may be determined that, in a particular application, an acceptable print quality may be accomplished, provided there are fewer than a predetermined number of defective printing elements. This predetermined number may vary depending on the combination of printer, print head and printing application, but may, for example be 10 printing elements within a print head comprising 1280 printing elements.

Alternatively, when a first predetermined number of printing elements are determined to be defective, a warning may be generated by the controller 10 to alert a user. When a second predetermined number of printing element are determined to be defective, the print head (and printer within which it is installed) may be prevented from operating until it has been replaced.

Alternatively, a record of the location of the defective printing element may be stored, and a warning generated, or use disabled, when there are a number of adjacent printing elements. For example, 20 defective printing elements within a print head containing 1280 printing elements may be deemed to produce print of a sufficiently high quality, provided they are distributed across the print head. However, a similar print head having just two adjacent defective printing elements may be deemed to be too unreliable for use. For example, when printing an image a feature may be entirely omitted where two adjacent printing elements are defective, whereas the feature may be partially printed where only a single printing element is defective.

In a further embodiment, an image to be printed may be shifted so as to ensure that one or more defective printing elements coincide with a region of the image in which no printing is required. For example, when printing a barcode, a single defective printing element, when aligned with a non-printed feature (i.e. a region of the image which required no ink) would not cause any detrimental effect on the print quality.

However, if a defective printing element was to coincide with a printed feature (i.e. a region of the image which required ink to be transferred) this would cause a detrimental effect on the print quality. In this case, it may be possible to shift the image to be printed, with respect to the print head, such that any defective printing elements are aligned with regions of the image in which no printing is required.

For example, where an image to be printing is as wide as 1000 printing elements, and is usually centred against a print head comprising 1280 printing elements, the image could be moved by as far as 140 printing elements in either direction to achieve a preferred alignment, taking into account defective printing elements. It will be appreciated that such significant changes in alignment may not be possible in some cases, where print position is critical. However, small image shifts of a single or small number of printing elements, each of which has a typical width of around 0.08 mm, may be acceptable in a large number of applications. Such a shift may allow printing to continue with a small number of defective printing elements, increasing production efficiency.

In a further alternative use of the resistance values calculated by the method described above, the calculated printing element resistance values may be used to predict future printing element failure. The characteristic resistance of a printing element is known to initially gradually decrease and then to eventually rapidly increase after prolonged use. Eventually the printing element resistance will increase to the extent that reliable printing performance can no longer be guaranteed. For example, where there is an increased print head resistance, a known voltage applied to the print head may cause a smaller current to flow in the printing element than would be expected for a printing element having a nominal resistance. The reduced current flow would cause a reduced amount of heat to be generated by the printing element, and consequently a risk that the heat generated was insufficient to ensure ink is transferred between a print ribbon and a substrate to be printed on, or to discolour a thermal print paper.

Furthermore, a printing element having a resistance which was a predetermined value, e.g. 10% above nominal resistance, could be predicted to fail, or deteriorate to an unacceptable level, after a further 100,000 printing cycles. In such a case, a printing element may not be categorised as defective by the conditions described above, but could be identified as expected to fail shortly.

Where a routine printing element testing procedure is followed, it may be expected that printing elements would be tested, for example, approximately every 1,000,000 print cycles. In this scenario, then a printing element expected to fail before the next routine test may be classified as defective, so as to ensure continued quality printing.

Alternatively, even where no printing elements are classified as defective, it may be possible to alert a user that a number of printing elements are expected to fail after a predetermined number of future printing cycles, which on a production line in constant use, may be a predictable future point in time. Such predictive alerts could ensure that productivity was not lost, by scheduling a print head replacement during routine interruptions to the production line, rather than suffering from unplanned interruptions.

In another embodiment, a printer may further comprise an optical device which examines each printed image. The optical device may be a digital camera. The optical device may be arranged to capture a digital image of a printed image. The detected image can be used to detect missing or faulty pixels and thereby adjust the printed image. For example, by comparing the intended image with the actual image of the ribbon, the optical device can detect "missing dots" (unprinted pixels on the image) on the ribbon and work either alone or in combination with the method described above intended to identify defective printing elements of the print head. In one embodiment, the detected image can be combined with the calculated resistance of printing elements of the print head to determine the status of resistive heating elements of the print head. In another embodiment the printer can shift the image along the print head to not use the faulty pixels for printing, but rather use the pixels that are determined to be working properly. That is, the image may be printed using only heating elements which are not detected to be faulty.

A missing pixel may also be caused by a dirty print head. The printer can then distinguish between missing pixels caused by a dirty print head and those that are caused by failures in the print head (such as defective printing elements). The controller can distinguish between a dirty printing element and a defective printing element. For example, if data generated by the optical device indicates that a pixel has been missed in the printed image and the measured printing element resistance value also indicates a defective printing element, a defective printing element message is generated. However, it the optical device indicates a missing pixel, but the measured printing element resistance value does not indicate a failure of the corresponding printing element, then it can be determined that the print head is likely dirty. The printer can be configured to provide a warning to the user that distinguishes between the two cases (e.g. "Please Change Printhead" in the former and "Please Clean Printhead" in the latter). The printer can also provide a user-friendly image shown on screen to give a WYSIWYG display of the dead/dirty heating elements or pixels, by showing which are printing properly, which have failed the resistance test, and which appear to be merely dirty.

In an embodiment, the process of determining the resistance of printing elements within a printhead may be used to determine the width of an installed printhead within a printer.

When a printer is switched on from an un-powered state, a printing element test is run. In such a test, each possible printing element address is addressed in turn (for example, by using a testing sequence described above with reference to FIG. 6). The testing of each possible printing element address may be referred to as a full-width printing element test.

By performing a full-width printing element test, some printing element addresses which do not correspond to printing elements within the printhead may be tested. For example, a printer may be capable of operating with a printhead having 1280 printing elements. However, the same printer may, for some applications be used with a printhead having a different number of printing elements, for example 640. In such an application, the printer will be capable of addressing each of the possible 1280 printing elements. As such, when a full-width printing element test is first run (i.e. after the printer is switched on) the printer will address each of the 1280 printing element addresses in turn so as to determine and record a printing element resistance for each of the 1280 printing element addresses. Where the installed printhead has fewer than 1280 printing elements, the resistance determined for the printing element addresses which correspond to the printing elements which are present (e.g. printing element addresses 1-640) will be the measured resistance values of the corresponding printing elements. However, the printing element addresses which do not have a corresponding printing element (e.g. printing element addresses 641-1280) will be determined to have an infinite resistance (e.g. an open circuit). Considering the circuit described above with reference to FIG. 2, when a heating element control signal is provided which addresses a printing element which is not present, there will be no connection made between the node A and the ground 14 as there is no switch 12 or heating element 11 to be driven by the heating element control signal. In such a case there is an open circuit and as a result no current flows through the current monitor 18 and consequently it is determined that the printing element has an infinite resistance.

Of course, it will be appreciated that where a printing element is present but defective or damaged the printing element test may also provide no circuit and consequently no current through the current monitor 18. As such, an infinite resistance indicates either that a printing element is not present or that the printing element is defective. Where a printing element is defective in this way the defective or damaged printing element cannot be used for printing, so can be regarded as a missing printing element for all practical purposes.

Once a resistance value has been determined for each of the printing element addresses, the installed printhead width is determined. This may be accomplished by reference to a list of possible printhead sizes which may, for example, be stored in a look-up table. Valid printhead sizes may, for example be 640 and 1280 printing elements, which may, for example, correspond to 53 mm and 107 mm wide printheads respectively having a printing element pitch of around 0.08 mm. It will be appreciated that alternative printhead sizes may be used.

The printhead width may thus be determined by selecting the smallest printhead size within the list which is greater than or equal to the address of the highest numbered active printing element. For example, if the printing element test identifies printing elements at each of the addresses 1-640, and no printing elements at addresses 641-1280, it will be determined that the printhead has 640 printing elements. Further, if the highest addressed printing element detected is at an address which is different from one of the sizes within the list, the next size above the highest addressed printing element is selected. For example, where the highest detected printing element is at address 630 (i.e. and no printing elements are identified at addresses greater than 630), it will be determined that the printhead size is 640 printing elements.

In an alternative embodiment, the print head width is determined by reference to the printing elements detected without reference to a predetermined list of possible printhead sizes. For example, where the highest detected printing element is at address 640 (i.e. and no printing elements are detected at addresses greater than 640), it will be determined that the printhead width is 640 printing elements.

As described above, where a printing element is defective or damaged, it may appear to be missing. Moreover, a printhead may contain several such damaged printing elements. Where the uppermost printing elements in a print head (i.e. those having the highest addresses) are damaged, the printhead width may be determined to be less than the actual printhead width. However, where those printing elements which are present, but which are not identified as being present are not counted, they cannot, in any event, be used for printing due to their being defective or damaged.

Once a printhead width has been determined, as described above, the printhead width value may be stored in a memory. The printhead may, for example itself include a memory device, allowing the determined printhead width value to be stored on the printhead. A printhead may thus initially have an unknown printhead width, and be assigned a printhead width stored on its memory device once it has been tested at least once.

Alternatively, or in addition, the determined printhead width value may be stored in a memory of the printer. Each printhead may have a unique identification (ID) code allowing it to be recognised when installed in a printer. The printhead ID may also be stored in the printer memory, allowing the printer to associate a particular printhead with a determined printhead width for that printhead.

In use, and after a printhead width has been determined, printing element tests may only test printing element addresses which correspond to printing elements which have previously been determined to be present. That is, between printing operations where routine printing element tests are carried out, it is unnecessary to re-test printing element addresses which correspond to printing elements which are not present.

Each time a printer is switched-on from an un-powered state, a full-width printhead test is carried out. Such a full-width printhead test allows verification that any stored printhead width value corresponds that the newly determined printhead width. A full-width printhead test also allows it to be determined that the printhead is properly connected (i.e. that there are no faulty cable connections). When the printer is switched-on from an un-powered state the printhead ID may also be checked, to identify whether a new printhead has been installed.

Where a full-width printhead scan is carried out (e.g. after switching on a printing) and a printhead width is determined which is greater than that which was previously determined for the same printhead the determined printhead width may be updated to the larger width. It is possible that an intermittent connection between the printhead and the printer results in some printing elements appearing to be missing. This may, for example, result from the use of a printhead having multiple banks of printing elements which are addressed by separate control signals. It will be appreciated that a first bank of printing element may be connected (and will thus be detected), while a second bank of printing elements may not be connected (and will thus not be detected). However, either during use, or during a routine inspection, the faulty connection may be improved, allowing all printing elements to be addressed. In such a scenario, a determined width of a printhead may be increased.

However, while a transition from a first printhead width to a second, greater, printhead width is permitted, an opposite transition from a first printhead width to a second, smaller, printhead width may not be permitted. Instead, where a determined printhead width is smaller than a previously determined printhead width an error signal may be generated, alerting an operator to check the printhead connection.

Further, where a determined printhead width is narrower than the full width of a printhead and where the detected printing elements are not aligned with the lowest numbered printing element addresses an error signal may be generated. However, it will be appreciated that where a small number of defective printing elements are detected at the lowest numbered printing element address (i.e. at the end of the printhead), printing may proceed as usual, provided the defective printing elements are not considered to cause too large a degradation in image quality.

Where it is identified that a new printhead has been installed without the printer having been powered off, for example by the presence of a new printhead identification chip, a full-width printing element test is carried out, to identify the width of the new printhead.

In an alternative printing technique, a ribbon may be omitted. Rather than transferring ink onto a substrate to be printed upon, a thermal paper may be used as the target surface. Thermal paper will change colour when exposed to a heat source. A print head, such as that described above, may be caused to come into contact directly with the thermal paper, a region of paper changing colour where a printing element was heated. Any techniques described with reference to a thermal transfer printer may therefore also be used to assess the health of a printing element in a thermal printer or in any form of printer in which a thermal printing element is used.

It will be appreciated that where alternative print heads are selected, then the values described above may change. For example, in larger print heads, a larger capacitor may be selected.

While various embodiments have been described above it will be appreciated that these embodiments are for all purposes exemplary, not limiting. Various modifications can be made to the described embodiments without departing from the spirit and scope of the present invention.

The invention claimed is:

1. An apparatus for determining the resistance of a printing element of a print head, the apparatus comprising:

a print head comprising a plurality of individually controllable printing elements connected in parallel, and a capacitor connected in parallel with the printing elements;

a test voltage supply arranged to supply a test voltage to the print head;

a current monitor arranged to measure a current supplied to one of the printing elements when the said one of the printing elements is connected to the test voltage supply, wherein the current monitor has a lower resistance than a nominal resistance of a printing element; and a controller arranged to determine a resistance of the said one of the printing elements based upon the measured current.

2. An apparatus according to claim 1, wherein the current monitor is connected in series between the test voltage supply and the print head.

3. An apparatus according to claim 2, wherein the current monitor comprises a sensing resistor connected in series between the test voltage supply and the print head, and a voltage amplifier for measuring the voltage across the sensing resistor.

4. An apparatus according to claim 3, wherein the sensing resistor has a lower resistance than the resistance of a printing element.

5. An apparatus according to claim 1, wherein the current monitor has a resistance of less than 100 ohms.

6. An apparatus according to claim 5, wherein the current monitor has a resistance of less than 10 ohms.

7. An apparatus according to claim 1, wherein the current monitor is switchably connected in series between the test voltage supply and the print head.

8. An apparatus according to claim 1, further comprising a voltage monitor arranged to monitor the voltage across the said one of the printing elements when said one of the printing elements is connected to the test voltage supply.

9. An apparatus according to claim 1, further comprising a printing voltage supply, the printing voltage supply being arranged to supply a printing voltage, wherein the test voltage is lower than the printing voltage.

10. An apparatus according to claim 1, further comprising a blocking diode arranged to prevent flow of current from the print head to the test voltage supply.

11. An apparatus according to claim 1, further comprising a discharge path for discharging the capacitor.

12. An apparatus according to claim 11 wherein the discharge path has a lower resistance than the resistance of a printing element.

13. An apparatus according to claim 12, wherein the discharge path has a resistance of less than 500 ohms.

14. A thermal transfer printer incorporating the apparatus of claim 1, the printer further comprising:

first and second spool supports each being configured to support a spool of ribbon; and a ribbon drive configured to cause movement of ribbon from the first spool support to the second spool support;

wherein the print head is configured to selectively transfer ink from the ribbon to a substrate, the print head being moveable towards and away from a printing surface, during printing.

15. A method of determining the resistance of at least two printing elements of a print head, the print head comprising a plurality of individually controllable printing elements connected in parallel, and a capacitor connected in parallel with the printing elements, the method comprising:

connecting a first one of the printing elements to a test voltage;

waiting for a predetermined time period;

measuring a current drawn by the first one of the printing elements from the test voltage; and determining a resistance of the first one of the printing elements based upon the measured current;

the method further comprising:

disconnecting the first one of the printing elements from the test voltage;

connecting a second one of the printing elements to the test voltage;

waiting for a time period less than the predetermined time period;

measuring a second current drawn by the second one of the printing elements from the test voltage; and determining a resistance of the second one of the printing elements based upon the measured second current.

16. A method according to claim 15 wherein measuring the current drawn by the first one of the printing elements comprises using a current monitoring device connected in series between a test voltage supply arranged to supply the test voltage and the print head.

17. A method according to claim 16 wherein the predetermined time period is sufficient to allow the current delivered to the first one of the printing elements from the test voltage supply to become substantially constant.

18. A method according to claim 15, wherein the predetermined time period is less than 30 milliseconds.

19. A method according to claim 18 wherein the predetermined time period is less than 10 milliseconds.

20. A method according to claim 15, wherein the time period less than the predetermined time period is less than 1 millisecond.

* * * * *